US009141072B2

(12) United States Patent
Gyotoku et al.

(10) Patent No.: US 9,141,072 B2
(45) Date of Patent: Sep. 22, 2015

(54) IMAGE FORMING APPARATUS AND IMAGE DELETION REDUCING METHOD

(71) Applicant: KYOCERA DOCUMENT SOLUTIONS INC., Osaka (JP)

(72) Inventors: Eiji Gyotoku, Osaka (JP); Jun Nakai, Osaka (JP); Masahito Ishino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/181,370

(22) Filed: Feb. 14, 2014

(65) Prior Publication Data

US 2014/0233973 A1 Aug. 21, 2014

(30) Foreign Application Priority Data

Feb. 15, 2013 (JP) ..... 2013-027572

(51) Int. Cl.
*G03G 15/00* (2006.01)
*G03G 21/00* (2006.01)
*G03G 21/20* (2006.01)

(52) U.S. Cl.
CPC ..... *G03G 21/0064* (2013.01); *G03G 21/0094* (2013.01); *G03G 21/20* (2013.01)

(58) Field of Classification Search
CPC G03G 21/0064; G03G 21/0094; G03G 21/20
USPC ..... 399/44, 96
See application file for complete search history.

(56) References Cited

U.S. PATENT DOCUMENTS 4,720,727 A * 1/1988 Yoshida ..... 399/93
4,737,822 A * 4/1988 Taniguchi et al. ..... 355/400
5,321,476 A * 6/1994 Gross ..... 399/66
5,633,703 A 5/1997 Takenouchi et al.
5,689,768 A * 11/1997 Ehara et al. ..... 399/96

(Continued)

FOREIGN PATENT DOCUMENTS

JP H07-271199 A 10/1995
JP 2002014589 A * 1/2002 ..... G03G 21/10

(Continued)

OTHER PUBLICATIONS

An Office Action; "Notice of Reasons for Rejection," issued by the Japanese Patent Office on Jun. 16, 2015, which corresponds to Japanese Patent Application No. 2013-027572 and is related to U.S. Appl. No. 14/181,370.

*Primary Examiner* — David Bolduc
(74) *Attorney, Agent, or Firm* — Studebaker & Brackett PC

(57) ABSTRACT

An image forming apparatus includes a heating element, an interior temperature/humidity detection section, and a controller. The heating element is conducted during connection of the image forming apparatus to an external power source to heat an image bearing member. The interior temperature/humidity detection section detects temperature and humidity in the interior of the image forming apparatus. The controller performs a refresh operation when a relative humidity calculated on the basis of the temperature and humidity detected by the interior temperature/humidity detection section immediately after the image forming apparatus is connected to the external power source is higher than the preset value. The refresh operation is an operation for supply of developer from a development device to the image bearing member and for polish of the surface of the image bearing member with the use of a polishing member.

10 Claims, 8 Drawing Sheets

(56) References Cited

U.S. PATENT DOCUMENTS

| | | | | |
|---|---|---|---|---|
| 6,198,491 | B1 * | 3/2001 | Honda | 347/129 |
| 2006/0140663 | A1 * | 6/2006 | Matsuura | 399/96 |
| 2006/0233565 | A1 * | 10/2006 | Tamaoki | 399/96 |
| 2007/0147861 | A1 * | 6/2007 | Takayanagi | 399/45 |
| 2007/0212625 | A1 * | 9/2007 | Suzuki et al. | 430/58.7 |
| 2008/0298831 | A1 * | 12/2008 | VanKouwenberg et al. | 399/92 |
| 2010/0073417 | A1 * | 3/2010 | Li et al. | 347/17 |
| 2012/0321347 | A1 * | 12/2012 | Daloia et al. | 399/128 |

FOREIGN PATENT DOCUMENTS

| | | | | |
|---|---|---|---|---|
| JP | 2005-156929 | A | | 6/2005 |
| JP | 2007-147821 | A | | 6/2007 |
| JP | 2007-264167 | A | | 10/2007 |
| JP | 2008-275703 | A | | 11/2008 |
| JP | 2008-310006 | A | | 12/2008 |
| JP | 2008310106 | A | * | 12/2008 |
| JP | 2010049121 | A | * | 3/2010 |
| JP | 2013228471 | A | * | 11/2013 |

* cited by examiner

IMAGE FORMING APPARATUS AND IMAGE DELETION REDUCING METHOD

INCORPORATION BY REFERENCE

The present application claims priority under 35 U.S.C. §119 to Japanese Patent Application No. 2013-027572, filed Feb. 15, 2013. The contents of this application are incorporated herein by reference in their entirety.

BACKGROUND

The present disclosure relates to image forming apparatuses, such as electrographic copiers, printers, facsimile machines, multifunction peripherals including two or more of them, etc. and methods for reducing image deletion.

Recently, amorphous silicon (a-Si) photosensitive drums are widely used as image bearing members for image forming apparatuses that employ an electrographic process. An a-Si photosensitive drum is high in hardness and has excellent durability. Accordingly, the characteristics as a photoreceptor may hardly degrade even after long term use and can maintain high image quality. In other words, its running cost may be low, and handling may be easy. Further, it can exhibit greater safety in environment. The a-Si photosensitive drum is an excellent image bearing member.

It has been known that image deletion is liable to be caused in an image forming apparatus with the a-Si photosensitive drum because of its characteristics. The image deletion means a phenomenon that toner runs around an image. The image deletion occurs in a way that an ion generating substance adhering to the photosensitive drum takes moisture in the air. Specifically, when the surface of the photosensitive drum is electrically charged with the use of a charger, nitrogen oxide (NOx) adheres to the surface of the photosensitive drum to take the moisture in the air. As a result, image deletion may be caused around the edge of an electrostatic latent image formed on the surface of the photosensitive drum.

Various methods for reducing occurrence of image deletion have been proposed. For example, a heating element (heater) is provided in the interior of the photosensitive drum. The heater generates heat on the basis of the temperature and humidity detected by a temperature/humidity sensor in the apparatus. This can evaporate the moisture adhering to the surface of the photosensitive drum, thereby reducing occurrence of image deletion.

Alternatively, some image forming apparatus includes a static eliminating section. The static eliminating section causes a light emitting element mounted on one of the surfaces of a substrate to emit light to irradiate the light to the photosensitive drum, thereby eliminating static electricity on the photosensitive drum. A heating element to heat the photosensitive drum is provided on the other surface of the substrate. Thus, occurrence of image deletion can be reduced.

SUMMARY

According to the first mode of the present disclosure, an image forming apparatus includes an image bearing member, a development device, and a cleaner. A photosensitive layer is formed on a surface of the image bearing member. The development device forms a toner image by supplying developer including toner to the image bearing member to cause the toner to be attached to an electrostatic latent image formed on the image bearing member. The cleaner is arranged downstream of the development device in a direction of rotation of the image bearing member, is in press contact with a surface of the image bearing member by a preset pressure, and includes a polishing member configured to polish the surface of the image bearing member. The image forming apparatus includes a heating element, an interior temperature/humidity detection section, and a controller. The heating element is configured to be conducted during connection of the image forming apparatus to the external power source to heat the image bearing member. The interior temperature/humidity detection section detects temperature and humidity in the interior of the image forming apparatus. The controller is capable of discerning whether or not the image forming apparatus is connected to the external power source. The controller performs a refresh operation when a relative humidity calculated on the basis of the temperature and humidity detected by the interior temperature/humidity detection section immediately after the image forming apparatus is connected to the external power source is higher than a preset value. The refresh operation is an operation for supply of the developer from the development device to the image bearing member and for polish of the surface of the image bearing member with the use of the polishing member.

According to the second mode of the present disclosure, an image forming apparatus performs a method for reducing image deletion. The image forming apparatus includes an image bearing member, a development device, and a cleaner. A photosensitive layer is formed on a surface of the image bearing member. The development device forms a toner image by supplying developer including toner to the image bearing member to cause the toner to be attached to an electrostatic latent image formed on the image bearing member. The cleaner is arranged downstream of the development device in a direction of rotation of the image bearing member, is in press contact with the surface of the image bearing member by a preset pressure, and includes a polishing member configured to polish the surface of the image bearing member. The method for reducing image deletion includes: recognizing connection of the image forming apparatus to an external power source; starting conduction to a heating element to heat the image bearing member upon the connection; calculating a relative humidity in the interior of the image forming apparatus on the basis of temperature and humidity in the interior of the image forming apparatus; and performing a refresh operation when the relative humidity is higher than a preset value. The refresh operation is an operation for supply of the developer from the development device to the image bearing member and for polish of the surface of the image bearing member with the use of the polishing member.

DETAILED DESCRIPTION

Figure 1:
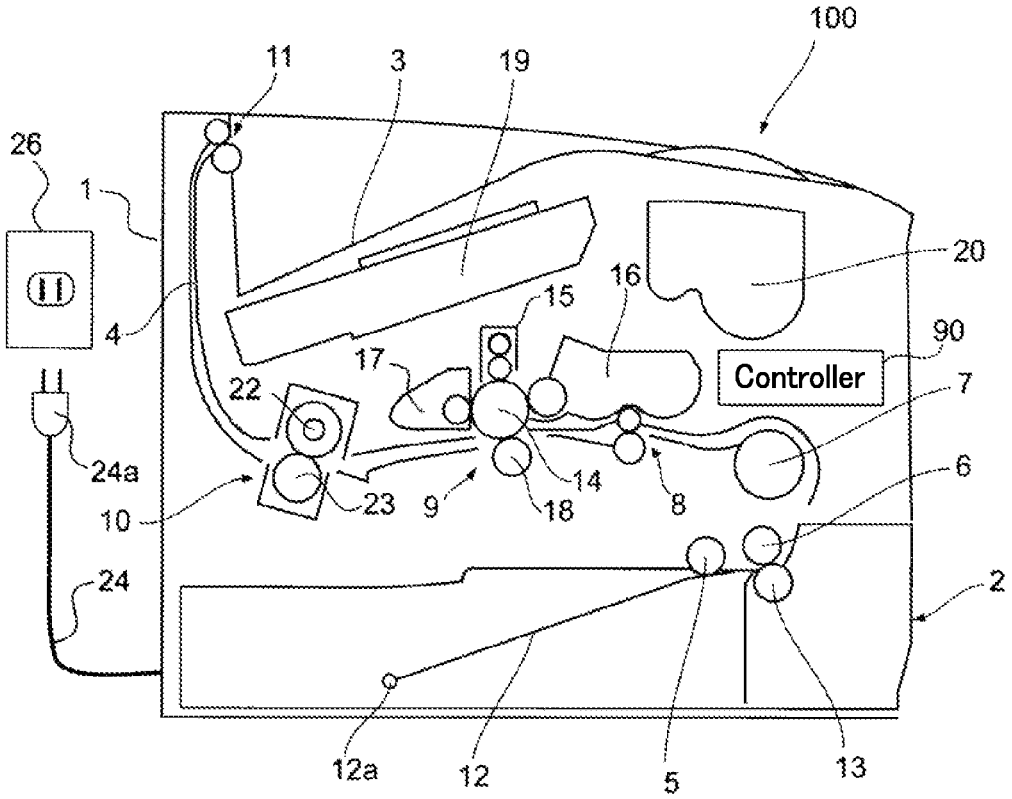
FIG. 1 is a schematic diagram showing an overall configuration of an image forming apparatus according to the first embodiment of the present disclosure.

Embodiments of the present disclosure will be described below with reference to the accompanying drawings. FIG. 1 is a schematic diagram showing an overall configuration of an image forming apparatus 100 according to the first embodiment of the present disclosure. The right side in FIG. 1 is the front side of the image forming apparatus 100. As shown in FIG. 1, the image forming apparatus 100 (monochrome printer herein) includes a paper feed cassette 2 in the lower part of a device body 1. The paper feed cassette 2 accommodates stacked sheets of paper (recording mediums). A paper conveyance path 4 (recording medium conveyance path) is formed above the paper feed cassette 2. The paper conveyance path 4 conveys paper. The paper conveyance path 4 extends substantially horizontally from the front part to the rear part of the device body 1. Further, the paper conveyance path 4 extends upward to reach a paper ejection section 3. The paper ejection section 3 is formed on the upper surface of the device body 1.

A pickup roller 5, a feed roller 6, an intermediate conveyance roller 7, a registration roller pair 8, an image forming section 9, a fusing device 10, and an ejection roller pair 11 are arranged along the paper conveyance path 4 in this order from the upstream side. In addition, a controller 90 is provided in the interior of the image forming apparatus 100. The controller 90 controls operations of each roller, the image forming section 9, the fusing device 10, etc.

Moreover, a power source cord 24 is connected to the device body 1. An insertion plug 24*a* is provided at the tip end of the power source cord 24. The insertion plug 24*a* is detachable from an external power source 26, such as a socket, tap, etc. Insertion of the insertion plug 24*a* to the external power source 26 can result in supply of electric power to each part in the device body 1.

The paper feed cassette 2 includes a paper loading plate 12. The paper loading plate 12 is supported to the paper feed cassette 2 turnably about a pivot fulcrum 12*a*. The pivot fulcrum 12*a* is located at the upstream end in a conveyance direction of paper (hereinafter it may be referred to as a paper conveyance direction). The pickup roller 5 presses paper (recording medium) loaded on the paper loading plate 12. Further, a retard roller 13 is arranged in front of the paper feed cassette 2 so as to be in press contact with the feed roller 6. When the pickup roller 5 sends plural sheets of paper simultaneously, the feed roller 6 and the retard roller 13 separate the plural sheets of paper. Thus, only the uppermost single sheet of paper can be conveyed.

Then, the intermediate conveyance roller 7 changes the conveyance direction of the paper separated by the feed roller 6 and the retard roller 13 rearward of the device body 1. Then, the paper is conveyed to the registration roller pair 8. The registration roller pair 8 adjusts paper conveyance timing to allow the paper to be conveyed to the image forming section 9.

The image forming section 9 forms a toner image on paper by an electrographic process. The image forming section 9 includes a photosensitive drum 14, a charger 15, a development device 16, a cleaner 17, a transfer roller 18 (transfer section), and an exposure device (e.g., laser scanning unit (LSU)) 19. The photosensitive drum 14 is an image bearing member axially supported so as to be rotatable in the clockwise direction in FIG. 1. The charger 15, the development device 16, and the cleaner 17 are arranged around the photosensitive drum 14.

The cleaner 17 is arranged downstream of the development device 16 in the direction of rotation of the photosensitive drum 14. The transfer roller 18 is disposed on the opposite side of the paper conveyance path 4 to the photosensitive drum 14. In other words, the paper conveyance path 4 is formed between the transfer roller 18 and the photosensitive drum 14. The transfer roller 18 is arranged downstream of the development device 16 in the direction of rotation of the photosensitive drum 14 and upstream of the cleaner 17 in the direction of rotation of the photosensitive drum 14. The exposure device 19 is disposed above the photosensitive drum 14. A toner container 20 to replenish toner to the development device 16 is disposed above the development device 16.

A photosensitive layer is formed on the surface of the photosensitive drum 14. In the present embodiment, the photosensitive drum 14 is an amorphous silicon (hereinafter referred to as "a-Si") photosensitive drum. Specifically, an a-Si based photoconductive layer is formed as a photosensitive layer on a conductive substrate (cylindrical body) of aluminum or the like. Then, a surface protection layer made from an a-Si based inorganic insulating material or inorganic semiconductor is formed on the surface of the photoconductive layer. Thus, the a-Si photosensitive drum is formed. The a-Si based inorganic insulating material or inorganic semiconductor may be SiC, SiN, SiO, SiON, or SiCN, for example.

When image data is input from a superordinate device, such as a personal computer, the charger 15 uniformly charges the surface of the photosensitive drum 14 first. Next, the exposure device 19 forms an electrostatic latent image based on the input image data on the photosensitive drum 14 with the use of a laser beam. Further, the development device 16 supplies developer including toner to the photosensitive drum 14 to allow the toner to be attached to the electrostatic latent image, thereby forming a toner image on the surface of the photosensitive drum 14. The transfer roller 18 transfers the toner image formed on the surface of the photosensitive drum 14 to paper supplied to a nip portion (transfer point) between the photosensitive drum 14 and the transfer roller 18. In other words, the transfer roller 18 transfers the toner image formed on the photosensitive drum 14 by the development device 16 to the paper.

The paper to which the toner image is transferred is separated from the photosensitive drum 14 and is conveyed toward the fusing device 10. The fusing device 10 is arranged downstream of the image forming section 9 in the paper conveyance direction. The fusing device 10 includes a heating roller 22 and a pressure roller 23. The pressure roller 23 is in press contact with the heating roller 22. The heating roller 22 and the pressure roller 23 respectively apply heat and pressure to the paper to which the toner image is transferred in the image forming section 9. Thus, the toner image transferred to the paper is fused. Then, the ejection roller pair 11 ejects the paper subjected to image formation in the image forming section 9 and the fusing device 10 to the paper ejection section 3.

After transfer, the cleaner 17 removes residual toner on the surface of the photosensitive drum 14. The static eliminator 25 (see FIG. 2) eliminates residual charge on the surface of the photosensitive drum 14. Then, the charger 15 charges again the photosensitive drum 14 so that image formation is performed thereafter in the similar manner.

Figure 2:
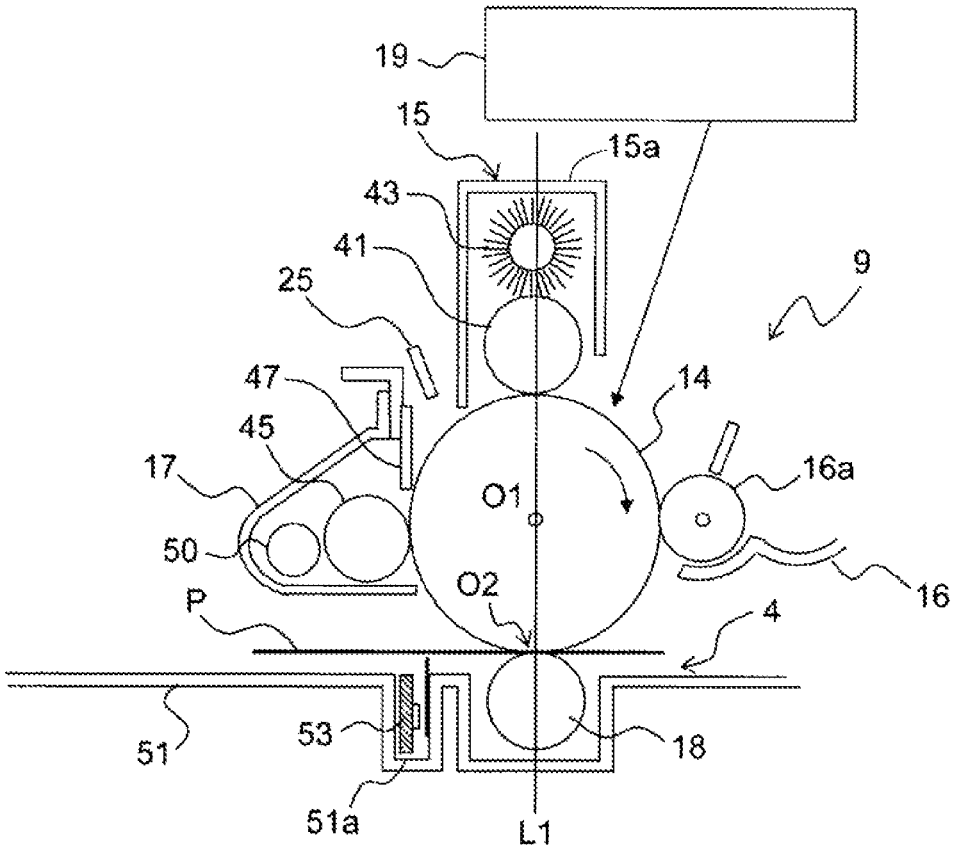
FIG. 2 is a partially enlarged view of an image forming section of the image forming apparatus according to the first embodiment of the present disclosure.
Figure 3:
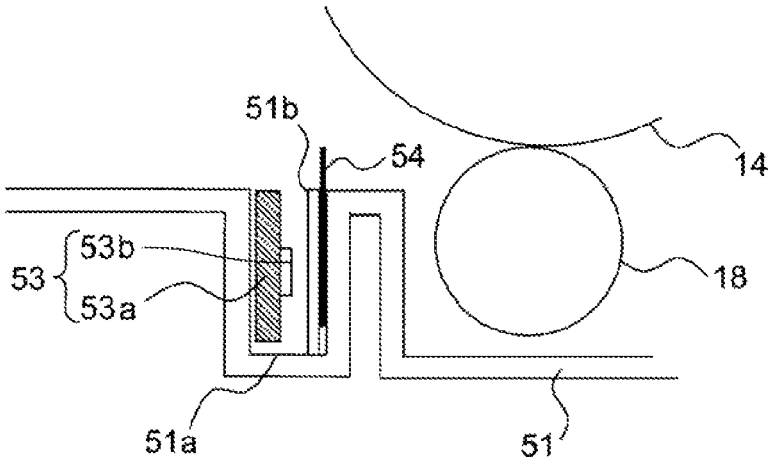
FIG. 3 is an enlarged cross sectional view of the vicinity of a nip portion between a photosensitive drum and a transfer roller of the image forming apparatus according to the first embodiment of the present disclosure.

FIG. 2 is a partially enlarged view of the vicinity of the image forming section 9 in FIG. 1. FIG. 3 is an enlarged view of the vicinity of the nip portion between the photosensitive drum 14 and the transfer roller 18 in FIG. 2. The charger 15 includes a charging roller 41 and a charging roller cleaning brush 43 in the interior of a charger housing 15*a*. The charging roller 41 is in contact with the photosensitive drum 14 and applies charge bias to the surface of the photosensitive drum 14. The charging roller 41 is made from conductive rubber and is arranged to be in contact with the photosensitive drum 14. The charging roller cleaning brush 43 cleans the charging roller 41.

When the photosensitive drum 14 rotates in the clockwise direction in FIG. 2, the charging roller 41 in contact with the surface of the photosensitive drum 14 follows and rotates in the anticlockwise direction in FIG. 2. In so doing, application of preset voltage to the charging roller 41 can result in uniform charging of the surface of the photosensitive drum 14. Further, accompanied by the rotation of the charging roller 41, the charging roller cleaning brush 43 in contact with the charging roller 41 follows and rotates in the clockwise direction in FIG. 2 to remove foreign matter adhering to the surface of the charging roller 41.

The development roller 16*a* of the development device 16 supplies toner to the electrostatic latent image formed on the photosensitive drum 14. Toner supply to the development device 16 is done through an intermediate hopper (not shown) from the toner container 20 (see FIG. 1). It is noted that one-component developer (hereinafter referred to merely as "toner") is filled in the development device 16 herein. The one-component developer is made from only a toner component having magnetic properties.

The cleaner 17 includes a friction roller 45 (polishing member), a cleaning blade 47, and a toner collecting roller 50. The friction roller 45 polishes the surface of the photosensitive drum 14. Specifically, the friction roller 45 is in press contact with the surface of the photosensitive drum 14 by a preset pressure. Further, the friction roller 45 is driven and rotated by a drum cleaning motor (not shown) in a direction that is the same as the direction of rotation of the photosensitive drum 14 at its contact surface to the photosensitive drum 14. This can cause the friction roller 45 to remove residual toner on the surface of the photosensitive drum 14 and to slide and rub on the photosensitive layer formed on the surface of the photosensitive drum 14 for polish with the use of the residual toner.

Furthermore, the toner supplied from the development device 16 is toner including abrasive (polishing toner). The polishing toner not only forms a toner image by being attached to an electrostatic latent image on the photosensitive drum 14 but also polishes the surface of the photosensitive drum 14 with the use of the residual toner not transferred from the transfer roller 18.

The linear velocity of the friction roller 45 is controlled to be higher than that of the photosensitive drum 14 (1.2 times herein). The linear velocity means a velocity in the circumferential direction at the surface of the friction roller 45 or the photosensitive drum 14. The friction roller 45 may have a configuration in which a foaming layer made from ethylene-propylene-diene terpolymer (EPDM) rubber and having an Asker C hardness of 55° is formed as a roller body around a metal shaft, for example.

The material for the roller body is not limited to EPDM rubber and may be another rubber material or foaming rubber. Further, the suitable range of the Asker C hardness for the roller body is from 10° to 90°. It is noted that an Asker C is one of durometers (spring type durometer) prescribed in the Society of Rubber Science and Technology, Japan Standard and is a measurement tool for measuring hardness. The Asker C hardness means a hardness measured by the above measurement tool. The higher the value is, the harder the material is.

The cleaning blade 47 is fixed with it in contact with the photosensitive drum 14 at a location downstream of the contact part of the surface of the photosensitive drum 14 with the friction roller 45 in the direction of rotation. A polyurethane rubber blade having a JIS hardness of 78° is used as the cleaning blade 47, for example. Further, the cleaning blade 47 is arranged at the contact point with the photosensitive drum 14 so as to form a preset angle with the tangent direction of the photosensitive drum 14. The material, hardness, and size of the cleaning blade 47, the entry amount and press contact force thereof to the photosensitive drum 14, and the like are appropriately set according to the specification of the photosensitive drum 14. It is noted that the JIS hardness means a hardness prescribed in Japanese Industrial Standards (JIS).

The toner collecting roller 50 collects toner and the like adhering to the friction roller 45 in a manner to rotate in the reverse direction of the direction of rotation of the friction roller 45 with it being in contact with the surface of the friction roller 45. A scraper (not shown) scrapes off the toner and the like collected by the toner collecting roller 50 from the surface of the toner collecting roller 50. The residual toner removed from the surface of the photosensitive drum 14 by the cleaning blade 47 and the waste toner scraped off from the surface of the toner collecting roller 50 are ejected outside the cleaner 17 by a collection spiral (not shown).

The transfer roller 18 transfers a toner image formed on the surface of the photosensitive drum 14 to paper P conveyed on the paper conveyance path 4 without any artifact. A transfer bias power source and a bias control circuit (both not shown) for application of transfer bias having a polarity opposite to that of the toner are connected to the transfer roller 18.

Moreover, the image forming apparatus 100 further includes a conveyance path resin member 51 (resin member). A heating element 53 to heat the photosensitive drum 14 is disposed on the conveyance path resin member 51. The conveyance path resin member 51 forms a conveyance surface of the paper conveyance path 4 on the side of the transfer roller 18. The heating element 53 is conducted during the time when the image forming apparatus 100 is connected to the external power source 26 to heat the photosensitive drum 14. In FIG. 2, the heating element 53 is arranged on the opposite side of a line L1 to the development device 16 (left in FIG. 2). The line L1 is a straight line passing through the center O1 of the axis of rotation (axial center) of the photosensitive drum 14 and a contact point O2 between the photosensitive drum 14 and the transfer roller 18.

As described above, arrangement of the heating element 53 to heat the photosensitive drum 14 outside the photosensitive drum 14 can eliminate the need to use a sliding electrode for connection of the heating element 53 to the power source. Accordingly, occurrence of contact failure can be reduced. Further, the heat generated by the heating element 53, which is arranged on the opposite side of the line L1 to the development device 16, may hardly be transmitted to the development device 16, thereby reducing precipitation and agglomeration of toner in the development device 16.

Furthermore, in the present embodiment, the heating element 53 is accommodated in a recess 51*a* (recess) formed in the conveyance path resin member 51 as the conveyance surface of the paper conveyance path 4 on the side of the transfer roller 18. This arrangement can result in that the heating element 53 may not get in the way of conveyance of paper P on the paper conveyance path 4. Still further, the heating element 53 can be remote from the cleaner 17, thereby reducing precipitation and agglomeration of waste toner in the cleaner 17.

Yet further, in the image forming apparatus 100 of horizontal conveyance type as shown in FIG. 1, the heating element 53 is always located perpendicularly under the photosensitive drum 14. Accordingly, air around the heating element 53, which is heated in conduction of the heating element 53, rises by convection to reach the photosensitive drum 14. This can result in effective temperature increase of the photosensitive drum 14 when compared with the case where the heating element 53 is arranged on the side of the photosensitive drum 14 above the paper conveyance path 4.

Figure 4:
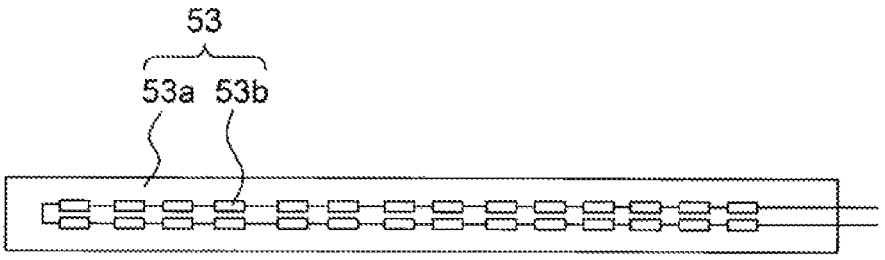
FIG. 4 is a plan view showing a configuration of a heating element mounted in the image forming apparatus according to the first embodiment of the present disclosure.

Furthermore, the heating element 53 includes a substrate 53*a* and a plurality of resistor chips 53*b* mounted on the substrate 53*a* (see FIG. 4). The heating element 53 is arranged so that the surface (left surface in FIG. 3) of the substrate 53*a*, on which no resistor chip 53*b* (see FIG. 4) is mounted, faces the inner wall surface of the recess 51*a*, while the other surface (right surface in FIG. 3) thereof, on which the resistor chips 53*b* are mounted, is located on the side of the photosensitive drum 14. Yet further, preset space is left between the surface on which the resistor chips 53*b* are mounted and the inner wall surface (partition wall 51*b*) of the recess 51*a*.

Accordingly, the substrate 53*a* intervenes between the resistor chips 53*b* and the inner wall surface of the recess 51*a*. This can suppress an increase in temperature of the inner wall surface of the recess 51*a*. Further, the space is formed on the side of the surface on which the resistor chips 53*b* are mounted. This can allow the air heated by the heat generated by the resistor chips 53*b* to readily move toward the photosensitive drum 14 (upward in FIG. 3). The distance between the surface on which the resistor chips 53*b* are mounted and the inner wall surface of the recess 51*a* is preferably equal to or larger than the thickness of the substrate 53*a* (1.6 mm herein).

It is noted that a separation probe 54 is provided downstream of the transfer roller 18 in the paper conveyance direction (direction from right to left in FIG. 2). The separation probe 54 is connected to a high voltage power source (not shown) to electrically attract paper P conveyed on the paper conveyance path 4, thereby separating the paper P from the photosensitive drum 14. The separation probe 54 is fixed at an edge of the recess 51*a*, in which the heating element 53 is disposed, on the upstream side of the heating element 53. A partition wall 51*b* is provided between the separation probe 54 and the heating element 53. Accordingly, brakeage of the heating element 53, which may be caused due to discharge from the separation probe 54 to the heating element 53, can be reduced.

FIG. 4 is a plan view showing the configuration of the heating element 53 used in the present embodiment. The heating element 53 is formed in such a fashion that the plurality of resistor chips 53*b* are arranged on the substrate 53*a*. The substrate 53*a* extends in the axial direction of the photosensitive drum 14 (direction perpendicular to the paper of FIG. 2). The temperature of the resistor chips 53*b* may increase up to around the resistance temperature of synthetic resin. For this reason, a member having low thermal conductivity, such as glass epoxy resin (e.g., CCL-EL190T produced by MITSUBISHI GAS CHEMICAL COMPANY, INC.) may be desirable to use as a material for forming the substrate 53*a*.

For example, the substrate 53*a* may be made from a material having a thermal conductivity equal to or lower than that of the conveyance path resin member 51. This can make it difficult to transmit the heat of the resistor chips 53*b* to the conveyance path resin member 51 through the substrate 53*a*. As a result, an increase in temperature of the conveyance path resin member 51 can be suppressed. One example of the material for the conveyance path resin member 51 may be polyphenylene sulfide resin (PPS; A310MX04 produced by Toray Industries, Inc., which has a thermal conductivity of 0.57 W/(m·k)). One example of the material for the substrate 53*a* may be paper phenolic resin (PLC-2147AQ produced by Sumitomo Bakelite Co., Ltd., which has a thermal conductivity of 0.25 W/(m·k)).

In the heating element 53 of the present embodiment, 28 resistor chips 53*b* having a resistance of 10Ω are arranged on the substrate 53*a*. A direct current voltage of 24 V is supplied to the resistor chips 53*b*. The output power of the heating element 53 at that time is 2.05 W.

Further, it is desirable that the relative temperature index (hereinafter referred to as RTI) of the resin material forming the conveyance path resin member 51 is higher than the surface temperature of the heating element 53 at heat generation. The RTI is an index that indicates degradation in mechanical properties (tensile strength and tensile impact) and an electrical property (dielectric breakdown strength) under long term exposure in a high temperature environment, which is determined in accordance with long term property evaluations, UL 746B in the US. In one example, where a resin has an RTI of 110, the mechanical properties and the electrical property of the resin are reduced to 50% from the initial stage after 100,000-hour exposure under an environment of 110° C. In view of this, when the heating element 53 is designed so that its surface temperature is lower than the RTI of the conveyance path resin member 51, the mechanical and electrical property of the conveyance path resin member 51 can be maintained up to the mechanical lifetime of the image forming apparatus 100.

Examples of the material for the conveyance path resin member 51 may include modified polyphenylene ether (m-PPE, XYRON SZ800 produced by Asahi Kasei Chemicals Corporation) in addition to the aforementioned polyphenylene sulfide resin.

Figure 5:
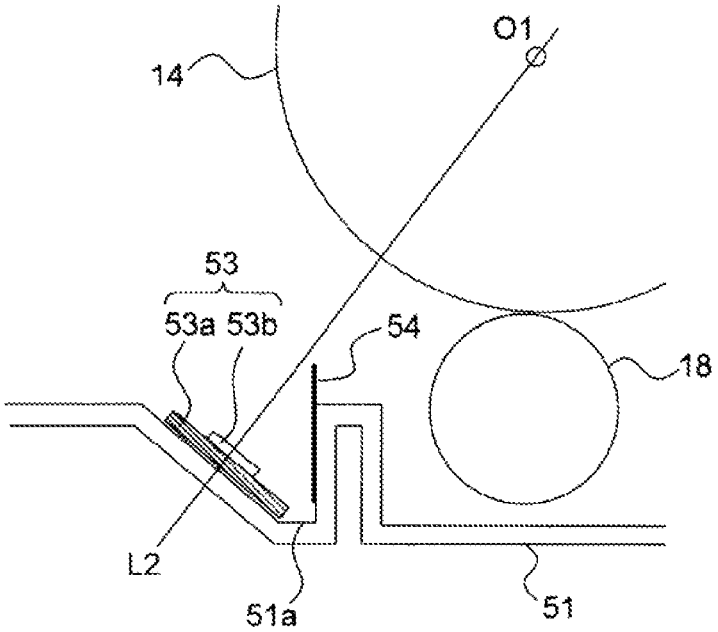
FIG. 5 is an enlarged cross sectional view of the vicinity of the nip portion between the photosensitive drum and the transfer roller, which shows another arrangement example of the heating element mounted in the image forming apparatus according to the first embodiment of the present disclosure.

FIG. 5 is a diagram showing another arrangement example of the heating element 53. In FIG. 5, the inner wall surface of the recess 51*a* on the downstream side (left in FIG. 5) forms an inclined surface relative to the paper conveyance direction. Further, the heating element 53 is arranged along the inclined surface so that a line L2 perpendicular to the substrate 53*a* passes through the center O1 of rotation of the photosensitive drum 14.

With this arrangement, the photosensitive drum 14 is heated directly by radiation heat from the resistor chips 53*b* in addition to heat by convection of the air heated by the heating element 53. Accordingly, the photosensitive drum 14 can be heated more efficiently than in the arrangement shown in FIG. 2. Moreover, the distance between the heating element 53 and the separation probe 54 can be increased, thereby reducing discharge from the separation probe 54 to the heating element 53.

Incidentally, in the present embodiment, the heating element 53 is conducted only by inserting the insertion plug 24*a* of the power source cord 24 into the external power source 26 (both shown in FIG. 1) even without turning on the main power source (main switch) of the image forming apparatus 100. With this configuration, the heating element 53 can be conducted as long as the insertion plug 24*a* is inserted in the external power source 26 even if the main power source of the image forming apparatus 100 is turned off in an unused state for a long period of time. Thus, the surface of photosensitive drum 14 is always heated. This can result in reduction in occurrence of image deletion in printing immediately after the main power source is turned on from off.

Herein, it has been proved by an experiment that the relative humidity around the surface of the photosensitive drum 14 is needed to be prevented from rising higher than 60% in order to reduce image deletion on the photosensitive drum 14. Where the relative humidity is 80% at an external temperature of 10-40° C., the surface temperature of the photosensitive drum 14 must be increased 6° C. relative to the atmospheric temperature in order to prevent the relative humidity around the surface of the photosensitive drum 14 from rising higher than 60%. The output power of the heating element 53 necessary for raising the temperature 6° C. or more is about 1-3 W.

By contrast, where the insertion plug 24*a* is not inserted in the external power source 26 for a long period of time, the output power of the heating element 53 is small even if conduction to the heating element 53 starts concurrently with insertion of the insertion plug 24*a* into the external power source 26. It takes three to four hours to increase the surface temperature of the drum by 6° C. For this reason, when the main power source is turned on from off, and printing operation is then performed immediately after insertion of the insertion plug 24*a* to the external power source 26, image deletion may occur where the relative humidity in the interior of the image forming apparatus 100 is in excess of 60%.

In order to tackle this problem, in the present embodiment, the controller 90 (see FIG. 1) performs drum refresh (refresh operation) when the relative humidity calculated on the basis of the temperature and humidity respectively detected by the interior temperature sensor 97*a* and interior humidity sensor 97*b* (see FIG. 6) immediately after the image forming apparatus 100 is connected to the external power source 26 is higher than a preset value. Specifically, when the insertion plug 24*a* is inserted into the external power source 26, a signal is transmitted to the controller 90. This causes the controller 90 to recognize connection of the image forming apparatus 100 to the external power source 26. Then, conduction to the heating element 53 starts, and the drum refresh is performed according to the relative humidity in the interior of the image forming apparatus 100 which is calculated on the basis of the values detected by the interior temperature sensor 97*a* and the interior humidity sensor 97*b*.

The drum refresh is an operation for supply of developer from the development device 16 to the photosensitive drum 14 and for polish of the surface of the photosensitive drum 14 with the use of the friction roller 45. One specific example of the drum refresh is to eject toner on the developing roller 16*a* in the development device 16 toward the photosensitive drum 14. Then, the photosensitive drum 14 and the friction roller 45 are rotated for a preset time period with the ejected toner interposed therebetween to cause friction against the photosensitive layer formed on the surface of the photosensitive drum 14 for polish.

Figure 6:
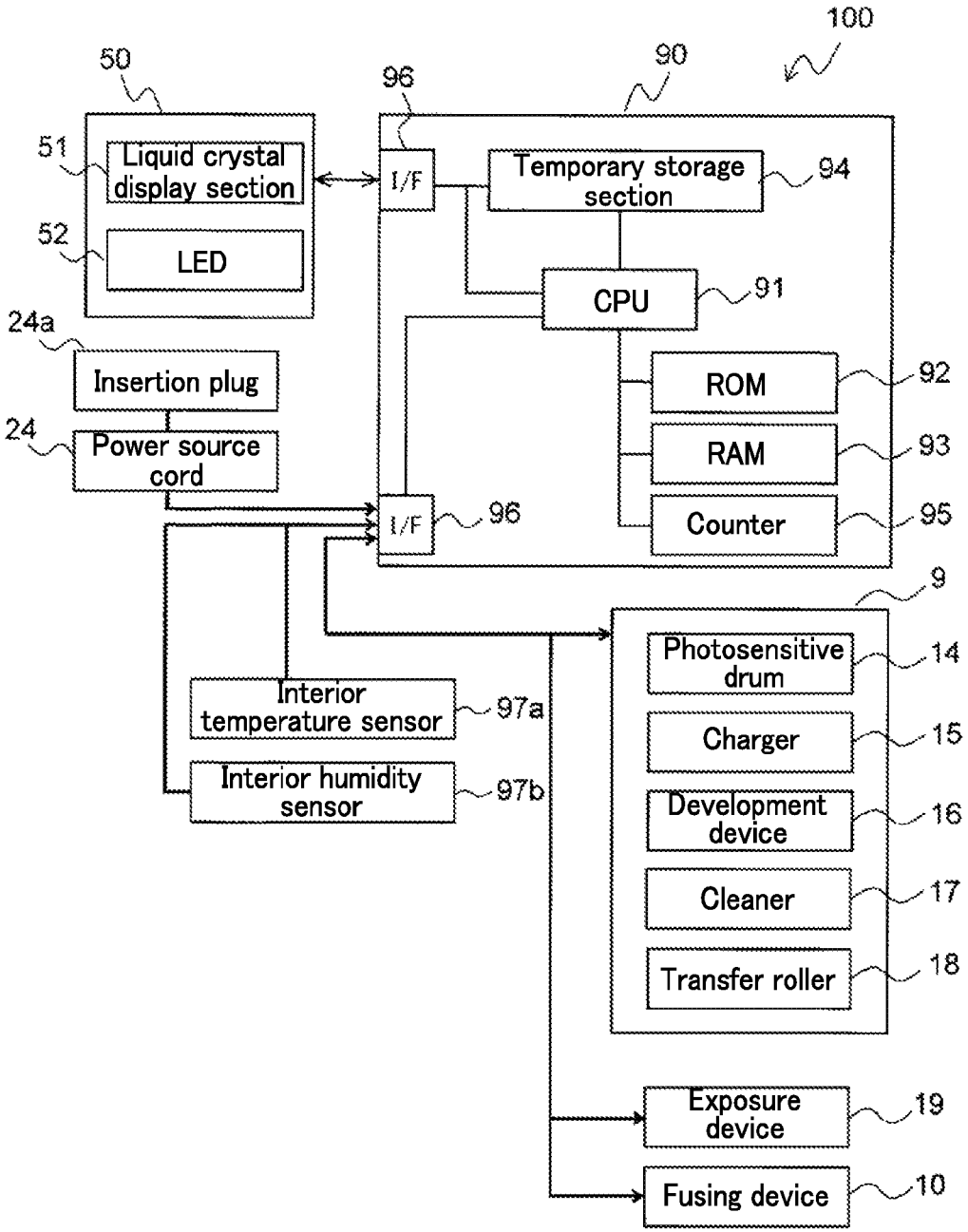
FIG. 6 is a block diagram for explaining one embodiment of a controller used in the image forming apparatus according to the first embodiment of the present disclosure.

FIG. 6 is a block diagram for explaining one embodiment of the controller 90 used in the image forming apparatus 100 according to the first embodiment of the present disclosure. It is noted that various control is performed on respective devices of the image forming apparatus 100 in operating the apparatus 100, and therefore, the entire control system of the image forming apparatus 100 is complicated. In view of this, the following description is focused herein on part necessary for reduction in practice of the present disclosure in the control system.

The controller 90 includes at least a central processing unit (CPU) 91, a read only memory (ROM) 92, a random access memory (RAM) 93, a temporary storage section 94, a counter 95, and a plurality of interfaces (I/Fs) 96. Further, the controller 90 can be arranged at any location inside the body of the image forming apparatus 100. The ROM 92 is a storage section dedicated to reading. The RAM 93 is a readable and writable storage section. The temporary storage section 94 temporarily stores image data and the like. The I/Fs 96 transmit control signals to respective devices in the image forming apparatus 100 and receive input signals from the operation section 50.

The ROM 92 stores control programs for the image forming apparatus 100, numeral values and the like necessary for the control, data not changed during use of the image forming apparatus 100, etc. The RAM 93 stores necessary data generated in the course of control on the image forming apparatus 100, data temporarily necessary for control on the image forming apparatus 100, etc. The counter 95 counts the number of printed pages. It is noted that the RAM 93 may store the number of printed pages, for example, without providing the counter 95 separately.

Moreover, the controller 90 transmits control signals to the respective parts and devices in the image forming apparatus 100 from the CPU 91 via the I/Fs 96. Still further, the respective parts and devices transmit signals indicating their status and input signals to the CPU 91 via the I/Fs 96. Examples of the respective parts and devices that the controller 90 in the present embodiment controls may include the image forming section 9, the exposure device 19, the fusing device 10, and the operation section 50.

The operation section 50 includes a liquid crystal display section 51 and an LED 52 indicating various states. The operation section 50 indicates the status of the image forming apparatus 100 and displays the state of image formation and the number of printing pages. Various settings to the image forming apparatus 100 are done through the printer driver of a personal computer.

Besides, the operation section 50 includes a stop/clear button, reset button, etc. The stop/clear button is used for stopping image formation and the like. The rest button is used for setting various settings of the image forming apparatus 100 to be into default.

The interior temperature sensor 97*a* and the interior humidity sensor 97*b* are arranged in the vicinity of the image forming section 9 and detect the temperature and humidity in the interior of the image forming apparatus 100, especially, the temperature and humidity of the surface or in the vicinity of the photosensitive drum 14, respectively. The interior temperature sensor 97*a* and the interior humidity sensor 97*b* cooperate to function as an interior temperature/humidity detection section to detect the temperature and humidity in the interior of the image forming apparatus 100.

Figure 7:
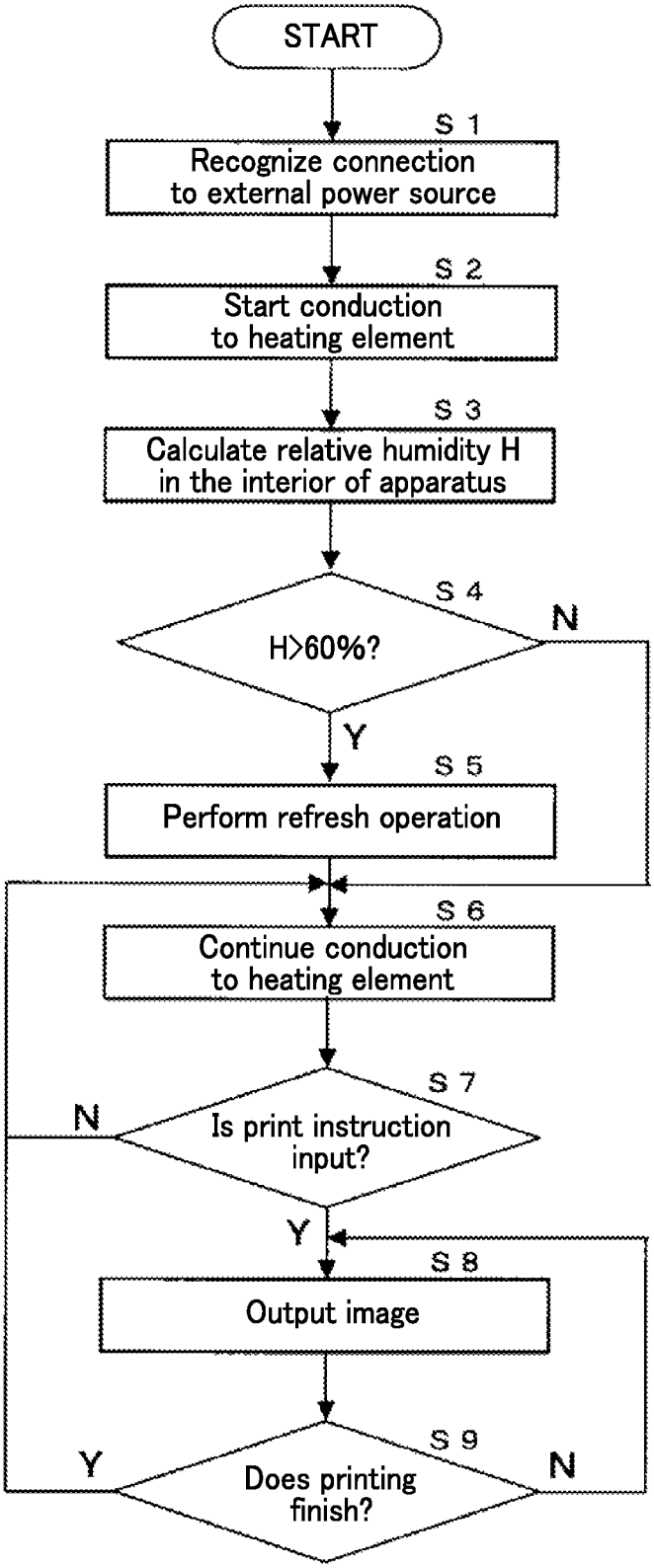
FIG. 7 is a flowchart depicting an example of control for dram refresh performed when the image forming apparatus according to the first embodiment of the present disclosure is connected to an external power source.

FIG. 7 is a flowchart showing an example of a control system for the drum refresh at connection of the image forming apparatus 100 of the present embodiment to the external power source 26. The execution sequence of the drum refresh will be described along the steps of FIG. 7, while referencing FIGS. 1-6 as needed.

When the insertion plug 24*a* is inserted into the external power source 26, a signal is transmitted to the controller 90, so that the connection of the image forming apparatus 100 to the external power source 26 is recognized (step S1). That is, the controller 90 is capable of discerning whether or not the image forming apparatus 100 is connected to the external power source 26. Simultaneously, (i.e., according to connection of the image forming apparatus 100 to the external power source 26), conduction to the heating element 53 starts (step S2). Also, the interior temperature sensor 97*a* and the interior humidity sensor 97*b* execute detection of the temperature and humidity in the interior of the image forming apparatus 100, respectively.

Next, the relative humidity H in the interior of the image forming apparatus 100 is calculated on the basis of the detected temperature and humidity (step S3). Then, the controller 90 determines whether or not the relative humidity H exceeds 60% (preset value) (step S4). If the relative humidity H exceeds 60% (YES in step S4), the drum refresh is performed by ejecting the toner on the developing roller 16*a* toward the photosensitive drum 14 and by rotating the photosensitive drum 14 and the friction roller 45 for a preset time period with the ejected toner interposed therebetween (step S5). Further, the conduction to the heating element 53 is continued (step S6). By contrast, if the relative humidity H is equal to or lower than 60% (NO in step S4), conduction to the heating element 53 is continued without performing the drum refresh (step S6).

Thereafter, the controller 90 determines whether or not a print instruction is input (step S7). If the print instruction is input (YES in step S7), an image is output (step S8). Subsequently, whether or not printing is finished is determined (step S9). If printing is finished (YES in step S9), the routine returns to step S6, and the next printing instruction is waited, while conduction to the heating element 53 is continued.

According to the above control sequence, upon recognition of connection of the image forming apparatus 100 to the external power source 26, whether or not the drum refresh is necessary is determined according to the relative humidity in the interior of the image forming apparatus 100. Accordingly, when the relative humidity is high, the drum refresh is performed immediately after connection to the external power source 26. This can obviate occurrence of image deletion even when temperature increase of the photosensitive drum 14 by the heating element 53 is not enough immediately after connection to the external power source 26. Further, the drum refresh is not performed under the environmental condition where the relative humidity is low enough to cause no image deletion. This can reduce waste of toner caused by unnecessary drum refresh.

Figure 8:
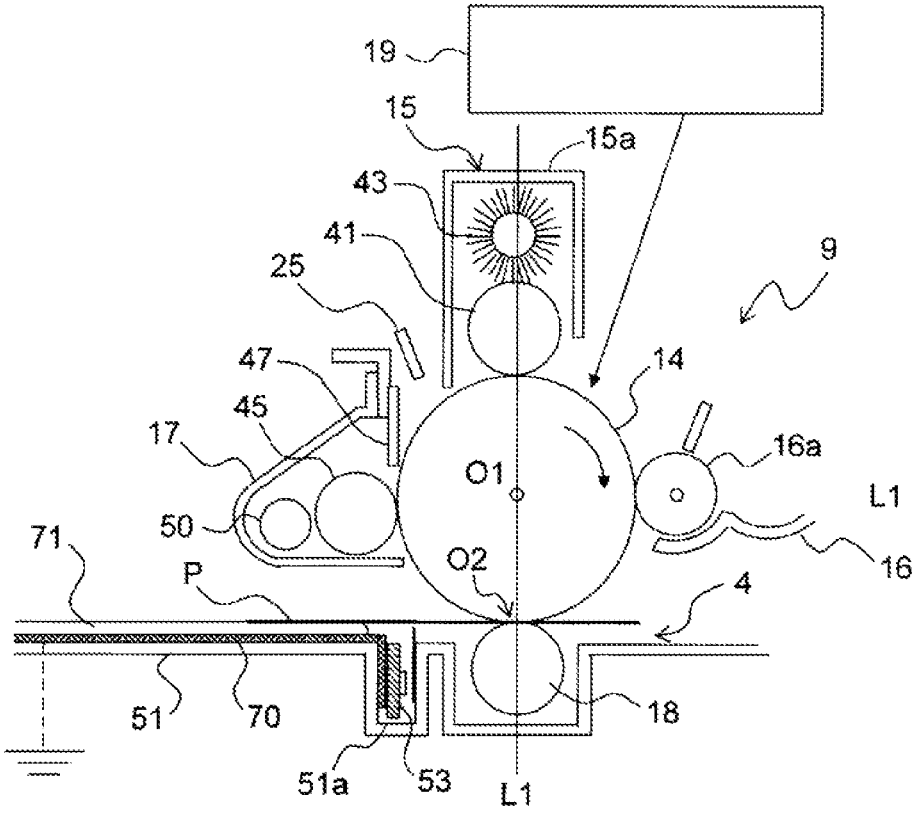
FIG. 8 is a partially enlarged view of an image forming section of an image forming apparatus according to the second embodiment of the present disclosure.
Figure 9:
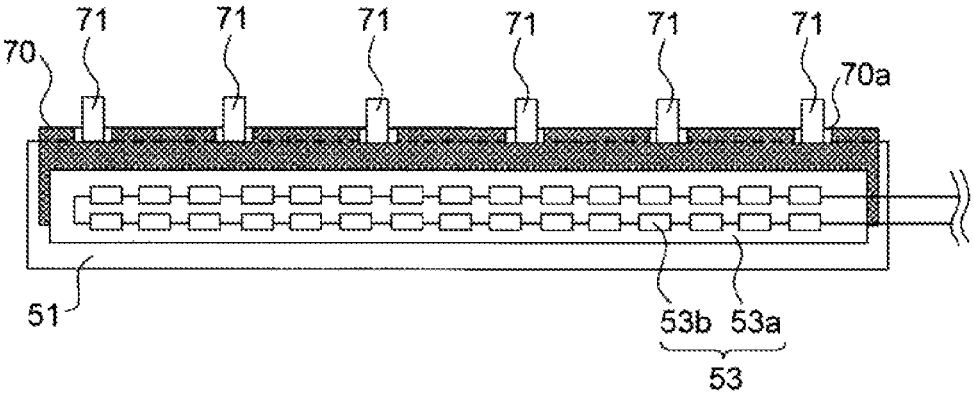
FIG. 9 is a view of a heating element and a conveyance plate used in the image forming apparatus according to the second embodiment of the present disclosure, as viewed from the right in FIG. 8.

FIG. 8 is a partially enlarged view showing the vicinity of an image forming section 9 of an image forming apparatus 100 according to the second embodiment of the present disclosure. FIG. 9 is a view of a heating element 53 and a conveyance plate 7, which are used in the image forming apparatus 100 of the second embodiment, as viewed from the right in FIG. 8. As shown in FIG. 8, the image forming apparatus 100 of the present embodiment further includes the conveyance plate 70. The conveyance plate 70 extends in the paper conveyance direction along the upper surface of the conveyance path resin member 51 from the inner wall surface of the recess 51*a*, in which the heating element 53 is arranged, on the downstream side in the paper conveyance direction (left in FIG. 8). Further, ribs 71 are formed on the upper surface of the conveyance path resin member 51. The ribs 71 protrude more than the surface of the conveyance plate 70. It is noted that the ribs 71 and the conveyance plate 70 shown in FIGS. 8 and 9 can be applied to the configuration in the first embodiment, although they are described in the second embodiment for the sake of convenience.

As shown in FIG. 9, a plurality of opening holes 70*a* are formed to open in the upper surface of the conveyance plate 70. Each of the plurality of opening holes 70*a* extends in the paper conveyance direction. The plurality of (six herein) ribs 71 protrude through the plurality of opening holes 70*a* in the paper conveyance path 4. The ribs 71 are formed integrally with the conveyance path resin member 51 on the upper surface thereof. Further, the surface of the substrate 53*a*, on which no resistor chip 53*b* is mounted, is fixed to the conveyance plate 70. Specifically, the surface of the substrate 53*a* forming the heating element 53, on which no resistor chip 53*b* is mounted, is fixed to part of the conveyance plate 70, which is bent along the inner wall surface of the recess 51*a*. The configuration of the other part is the same as that in the first embodiment shown in FIG. 2. The control for drum refresh at connection to the external power source 26 is also the same as that shown in FIG. 7. Therefore, the description is omitted.

The conveyance plate 70 is arranged on the upper surface of the conveyance path resin member 51 in the present embodiment. Accordingly, paper P, which is charged by transfer bias applied to the transfer roller 18, is electrically attracted to the conveyance plate 70. This can result in the paper P attracted on the conveyance path resin member 51, thereby smoothly conveying the paper P along the conveyance path resin member 51. Further, the ribs 71 are formed on the upper surface of the conveyance path resin member 51 so as to protrude more than the surface of the conveyance plate 70. This can prevent direct contact of the paper P to the conveyance plate 70, thereby obviating flowing in of the transfer current to the conveyance plate 70.

Yet further, a material having a thermal conductivity higher than that of the conveyance path resin member 51 is used for the conveyance plate 70. The substrate 53*a* of the heating element 53 is fixed to the conveyance plate 70. In the present embodiment, a galvanized steel plate having a thermal conductivity of 50.0 W/(m·k) (SECC produced by Sumitomo Metal Industries, Ltd.) is used as a material for the conveyance plate 70. Moreover, XYRON SZ800 produced by Asahi Kasei Chemicals Corporation, which has a thermal conductivity of 0.16-0.20 W/(m·k), is used as a material for the conveyance path resin member 51. Yet, CCL-EL190T having a thermal conductivity of 0.45 W/(m·k) is used as a material for the substrate 53*a*. That is, the thermal conductivity of the conveyance plate 70 in this example is higher than each thermal conductivity of the substrate 53*a* and the conveyance path resin member 51.

Thus, the conveyance plate 70 plays a role of a heat radiation plate (heat sink), thereby achieving efficient radiation of the heat, which is transmitted from the resistor chips 53*b* to the substrate 53*a*, from the conveyance plate 70. Thus, degradation and breakage, which may be caused by the heat of the substrate 53*a*, can be reduced.

The present disclosure is not limited to the above embodiments and can be modified in various manners within the scope not departing from the subject matter of the present disclosure. In one example, a charger of corona charging type including a corona wire and a grid may be employed rather than the charger 15 of contact charging type including the charging roller 41 as shown in FIG. 2. Moreover, a development device of two-component developer type that uses two-component developer including toner and a magnetic carrier may be employed rather than the development device 16 of one-component developer type.

Further, the image forming apparatus according to the present disclosure is not limited to the monochrome printer shown in FIG. 1 and may be another image forming apparatus, such as a monochrome/color copier, digital multifunction peripheral, color printer, and facsimile.

The present disclosure is applicable to an image forming apparatus including an image bearing member, such as a photosensitive drum, and a charger to charge the image bearing member. The image forming apparatus utilizing the present disclosure can effectively reduce occurrence of image deletion in printing operation immediately after connection to the external power source where it is not connected to the external power source for a long period of time.

According to the present disclosure, upon recognition of connection to the external power source, whether or not the drum refresh is necessary to perform is determined according to the relative humidity in the interior of the image forming apparatus in which the heating element that heats the image bearing member is conducted when the apparatus is connected to the external power source. When the relative humidity is high, the drum refresh is performed immediately after connection to the external power source. Accordingly, even if a temperature increase of the image bearing member by the heating element is not enough, occurrence of image deletion can be obviated. In addition, the drum refresh is not performed under an environmental condition where the relative humidity is low enough to cause no image deletion. This can reduce waste of toner caused by unnecessary drum refresh.

What is claimed is:

1. An image forming apparatus which includes:

an image bearing member having a surface on which a photosensitive layer is formed;

a development device configured to form a toner image by supplying developer including toner to the image bearing member to cause the toner to be attached to an electrostatic latent image formed on the image bearing member; and a cleaner which is arranged downstream of the development device in a direction of rotation of the image bearing member, which is configured to be in press contact with the surface of the image bearing member by a preset pressure, and which includes a polishing member configured to polish the surface of the image bearing member, the apparatus comprising:

a heating element configured to be conducted during connection of the image forming apparatus to an external power source to heat the image bearing member;

an interior temperature/humidity detection section configured to detect temperature and humidity in the interior of the image forming apparatus;

a controller capable of discerning whether or not the image forming apparatus is connected to the external power source, a transfer section which is arranged downstream of the development device in the direction of rotation and upstream of the cleaner in the direction of rotation and which is configured to transfer the toner image formed on the image bearing member by the development device to a recording medium;

a recording medium conveyance path which is provided between the transfer section and the image bearing member and which is configured to convey the recording medium; and a resin member forming a conveyance surface of the recording medium conveyance path on a side of the transfer section, and a recess is formed in the resin member, wherein the controller performs a refresh operation when a relative humidity calculated on the basis of the temperature and the humidity detected by the interior temperature/humidity detection section immediately after the image forming apparatus is connected to the external power source is higher than a preset value, the refresh operation is an operation for supply of the developer from the development device to the image bearing member and for polish of the surface of the image bearing member with the use of the polishing member, and the heating element is arranged on an opposite side of a line to the development device and is accommodated in the recess, the line passing through an axial center of the image bearing member and a contact point between the image bearing member and the transfer section.

2. An image forming apparatus according to claim 1, wherein the heating element includes:

a substrate; and a plurality of resistor chips mounted on the substrate, and the heating element is arranged such that a surface of the substrate, on which no resistor chip is mounted, faces an inner wall surface of the recess and a surface of the substrate, on which the resistor chips are mounted, is located on a side of the image bearing member.

3. An image forming apparatus according to claim 2, wherein the heating element is arranged such that a line perpendicular to the substrate passes through the axial center of the image bearing member.

4. An image forming apparatus according to claim 2, wherein the substrate is made from a material having a thermal conductivity equal to or lower than that of the resin member.

5. An image forming apparatus according to claim 2, wherein the resin member has a relative temperature index higher than a surface temperature of the heating element at heat generation.

6. An image forming apparatus according to claim 2, further comprising:

a conveyance plate extending in a conveyance direction of the recording medium along an upper surface of the resin member from the inner wall surface of the recess, wherein the surface of the substrate on which no resistor chip is mounted is fixed to the conveyance plate.

7. An image forming apparatus according to claim 6, wherein the conveyance plate has a thermal conductivity higher than the substrate and the resin member.

8. An image forming apparatus according to claim 6, wherein a rib protruding more than a surface of the conveyance plate is formed on an upper surface of the resin member.

9. An image forming apparatus according to claim 1, further comprising:

a separation probe which is arranged downstream of the transfer section in the conveyance direction of the recording medium and which is connected to a high voltage power source, wherein a partition wall is provided between the separation probe and the heating element.

10. An image deletion reducing method that an image forming apparatus performs, the image forming apparatus including:

an image bearing member having a surface on which a photosensitive layer is formed;

a development device configured to form a toner image by supplying developer including toner to the image bearing member to cause the toner to be attached to an electrostatic latent image formed on the image bearing member;

a cleaner which is arranged downstream of the development device in a direction of rotation of the image bearing member, which is configured to be in press contact with the surface of the image bearing member by a preset pressure, and which includes a polishing member configured to polish the surface of the image bearing member, a transfer section which is arranged downstream of the development device in the direction of rotation and upstream of the cleaner in the direction of rotation and which is configured to transfer the toner image formed on the image bearing member by the development device to a recording medium;

a recording medium conveyance path which is provided between the transfer section and the image bearing member and which is configured to convey the recording medium;

a resin member forming a conveyance surface of the recording medium conveyance path on a side of the transfer section, and a recess is formed in the resin member, the method comprising:

recognizing connection of the image forming apparatus to an external power source;

starting conduction to a heating element to heat the image bearing member upon the connection;

calculating a relative humidity in the interior of the image forming apparatus on the basis of temperature and humidity in the interior of the image forming apparatus; and performing a refresh operation when the relative humidity is higher than a preset value, wherein the refresh operation is an operation for supply of the developer from the development device to the image bearing member and for polish of the surface of the image bearing member with the use of the polishing member, and the heating element is arranged on an opposite side of a line to the development device and is accommodated in the recess, the line passing through an axial center of the image bearing member and a contact point between the image bearing member and the transfer section.

* * * * *